United States Patent [19]

Beckmann et al.

[11] 4,178,696

[45] Dec. 18, 1979

[54] METHOD AND APPARATUS FOR MIXING TWO GAS CURRENTS

[75] Inventors: Georg Beckmann; Alfred Trötzmüller, both of Vienna, Austria

[73] Assignee: Waagner-Biro A.G., Vienna, Austria

[21] Appl. No.: 916,788

[22] Filed: Jun. 19, 1978

[30] Foreign Application Priority Data

Jul. 1, 1977 [AT] Austria ..... 4685/77

[51] Int. Cl.[2] ..... F26B 7/00; F26B 21/10

[52] U.S. Cl. ..... 34/13; 34/20; 34/62; 34/68; 202/228

[58] Field of Search ..... 34/13, 20, 62, 66; 202/228

[56] References Cited

U.S. PATENT DOCUMENTS

| | | | |
|---|---|---|---|
| 3,959,084 | 5/1976 | Price | 34/13 |
| 4,037,330 | 7/1977 | Kemmetmuller | 34/20 |
| 4,054,424 | 10/1977 | Staudinger et al. | 34/13 |

*Primary Examiner*—John J. Camby

*Attorney, Agent, or Firm*—Steinberg & Blake

[57] ABSTRACT

A method and apparatus for mixing a first relatively cool gas current and a second relatively hot gas current in a manner such that the resulting gas current has a relatively uniform temperature immediately subsequent to the point of mixing. The first gas current is separated into first and second partial gas currents, the first partial gas current being directed to a conduit which branches from the conduit in which the second partial gas current is directed. The first partial gas current is directed at a relatively high velocity into a central nozzle in fluid communication with the second gas current while the second partial gas current is directed into a ring nozzle which also is in fluid communication with the second gas current and which concentrically surrounds the central nozzle. The flow of the first gas current is regulated by throttling the second partial gas current while maintaining the flow of the first partial gas current. The method and apparatus has particular application in the regulation of the inlet temperature to a heat exchanger of a cooling gas current in a dry cooling plant for hot bulk materials, such as coke.

13 Claims, 3 Drawing Figures

METHOD AND APPARATUS FOR MIXING TWO GAS CURRENTS

BACKGROUND OF THE INVENTION

This invention relates generally to a method and apparatus for mixing two gas currents and, more particularly, to a method and apparatus for mixing two gas currents at different temperatures to obtain a resulting gas current having a relatively uniform temperature at a point immediately subsequent to the mixing point.

It is necessary in many commerical applications to mix two gas currents at different temperatures in order to obtain a resulting gas current having a relatively uniform temperature. More particularly, in the past in such applications, where two gas currents at different temperatures have been mixed by, for example, introducing the first gas current into the second via a conventional T-joint coupler, it has been found that the resulting gas current is characterized by a temperature gradient over a given cross section. This temperature gradient, which is undesirable in most applications, results from the tendency for the two gas currents to fail to intermix sufficiently with each other.

Thus, in many commercial applications, such for example as where the intermixed gas current is directed over the heating surfaces of a heat exchanger in a cooling plant for hot particulate material, the heat exchange efficiency is reduced. The problem becomes especially acute where a first gas current with a varying mass flow rate and varying temperature is mixed with another gas current.

SUMMARY OF THE INVENTION

Accordingly, one object of the present invention is to provide a new and improved method and apparatus for mixing two gas currents having different temperatures.

Another object of the present invention is to provide a new and improved method and apparatus for mixing two gas currents at different temperatures so that the resulting gas current has a uniform temperature immediately subsequent to the point of mixing.

In accordance with the present invention, these and other objects are obtained by providing a first fluid conduit for a first gas current and a second fluid conduit for the second gas current, the first fluid conduit terminating at a ring nozzle in fluid communication with the second fluid conduit at the point of mixing. A branch line extends from the first fluid conduit at a juncture where the first gas current is separated into a first partial gas current which is directed through the branch line and a second partial gas current which is directed through the first fluid conduit. The branch line terminates at a central nozzle concentrically surrounded by the ring nozzle at the point of mixing with the second gas current. Means are provided in the branch line to increase the velocity of the first partial gas current, which current is smaller than the second partial gas current. Accordingly, at the point of mixing, the outlet velocity of the first partial gas current from the central nozzel is higher than that of the second partial gas current from the ring nozzle. Means are provided at the junction point of a first and second partial gas current for throttling the second partial gas current thereby increasing the first partial gas current.

In the application of the invention to a dry cooling plant for hot particulate material, such as coke, the smaller first partial gas current is drawn from the first gas current by means of a blower whereupon it is directed at least partially through the hot coke which heats the first partial gas current increasing its velocity whereupon it is fed to a central nozzle surrounded by a ring nozzle through which the second, larger partial gas current flows. The central and ring nozzles direct the first gas current into the path of the second gas current which itself has been passed through the hot coke thereby obtaining an elevated temperature. In order to further regulate the mixing characteristics of the first and second gas currents, the central nozzle through which the first partial gas current is directed into the second gas current is adjustable in its axial direction relative to the ring nozzle.

By virtue of this method and construction, the velocity distribution of the first gas current exiting from the ring and central nozzles is such as to result in intimate mixing of the two gas currents at the point of mixing so that a relatively uniform temperature of the resulting gas mixture is obtained.

DESCRIPTION OF THE DRAWINGS

The invention comprises the novel constructions hereinafter described and claimed for carrying out the above stated objects as will be apparent from the following description of the preferred forms of the invention, illustrated with reference to the accompanying drawings wherein:

DESCRIPTION OF THE PREFERRED EMBODIMENTS

Figure 1:
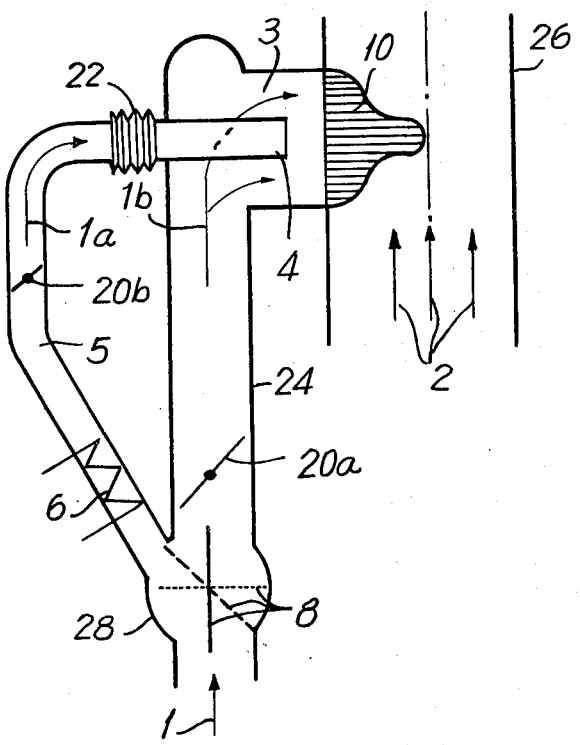
FIG. 1 is a schematic illustration of the apparatus of the present invention.

Referring now to the drawings, wherein like reference characters designate identical or corresponding parts throughout the several views, and more particularly to FIG. 1, a first gas current 1 is directed through a first fluid conduit 24 while a second gas current 2 is directed through a second fluid conduit 26. The second gas current 2 is generally at a higher temperature than that of the first gas current 1. The first fluid conduit 24 terminates at a ring nozzle 3 which is in fluid communication with second fluid conduit 26. More particularly, in the preferred embodiment, ring nozzle 3 has a longitudinal axis which is substantially perpendicular to the direction of travel of the second gas current 2. It is an object of the invention to obtain a mixing of the first and second gas currents 1, 2 so that the resulting gas current has a relatively uniform temperature over a given cross section at a point immediately subsequent to the point of mixing, i.e., the point at which ring nozzle 3 communicates with second fluid conduit 26.

To this end, a branch line 5 emanates from first fluid conduit 24 at junction 28. As seen in FIG. 1, branch line 5 preferably has a reduced cross sectional area relative to first fluid conduit 24. Branch line 5 extends in a substantially parallel manner to first fluid conduit 24 and terminates at a central nozzle 4 concentrically surrounded by ring nozzle 3. In other words, the longitudinal axis of central nozzle 4 lies substantially on the longitudinal axis of ring nozzle 3. Thus, as is evident from FIG. 1, central nozzle 4 fluidly communicates with second fluid conduit 26.

The first gas current 1 is separated at junction 28 into a first partial gas current, designated 1a, which is directed through branch line 5 and a second partial gas current, designated 1b, which continues to travel upwardly in first fluid conduit 24.

According to the invention, apparatus for increasing the velocity of the first partial gas current 1a is provided within branch line 5. Thus, as shown in FIG. 1, a heating element 6 is located within branch line 5 which heats the first partial gas current thereby increasing its velocity in the branch line.

As shown in FIG. 1, the effect of the introduction of the high velocity first partial gas current 1a through central nozzle 4 and second partial gas current 1*b* through ring nozzle 3 produces a velocity distribution of the first gas current 1 illustrated by the hatched area 10. More particularly, the velocity distribution of the first gas current entering into the second fluid conduit 26 at the mixing point is such that the velocity is greatest in the center of the cross sectional entry area and diminishes as the distance from the center increases. It has been found that the provision of such a velocity distribution effectively results in an intimate mixing of the first and second gas currents not heretofore possible. This intimate mixing has the desirable result of producing a uniform temperature in the resulting gas current, i.e., the gas current resulting from the mixture of the first and second gas currents.

It is not uncommon for the mass flow rate of the first gas current in certain applications to change during operation. In such circumstances, it is essential to maintain a proper correlation between the velocity and flow rate within branch line 5 of the first partial gas current and the flow through the first fluid conduit 24 of the second partial gas current 1b. Of course, these relationships can be determined empirically with regard to the particular application in which the present invention is employed. To achieve the proper flow rate, a throttle valve 8 is provided at the junction 28 between first fluid conduit 24 and branch line 5. In normal operation, throttle valve 8 is positioned as shown in the solid line configuration. When it is necessary to vary the quantity of the first gas current to be mixed with the second gas current, the throttle valve 8 is moved from the solid line position into the position indicated by the broken lines. In this position, it is seen that all of the flow through the first fluid conduit 24 is abated, i.e., the second partial gas current is stopped and all of the first gas current 1 is directed through branch line 5 whereupon its velocity is increased by means of the heater 6. Where mixing is to be abated completely, throttle valve 8 is turned to the position shown by the dotted lines.

It has also been found that under certain flow conditions, it is beneficial to change the axial position of central nozzle 4 with respect to ring nozzle 3 in order to achieve the optimum velocity distribution of the first gas current within the second gas current at the mixing point. Thus, an axially adjustable joint, such as a bellows joint 22 may be provided so that the axial position of central nozzle 4 may be varied.

Figure 2:
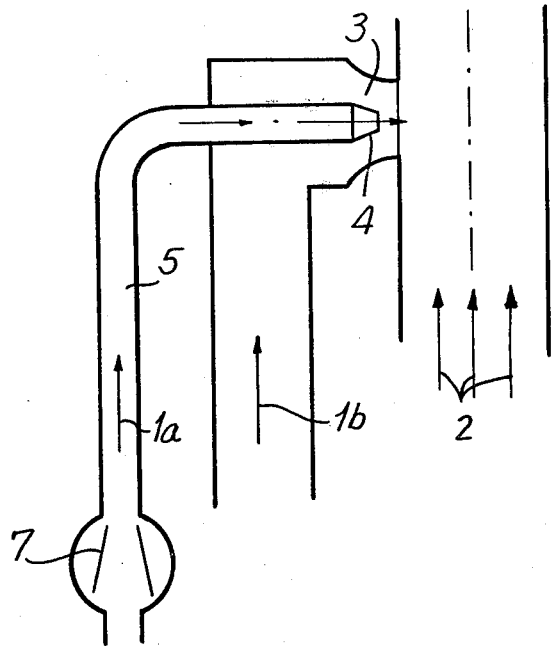
FIG. 2 is a schematic illustration of another embodiment of the present invention.

Referring to FIG. 2, another embodiment of the present invention is illustrated. In this embodiment, a fan or blower 7 is located in branch line 5 in lieu of the heater 6 (FIG. 1) in order to increase the velocity of the first partial gas current 1a flowing through the branch line 5. Further, the ring nozzle 3 is provided with a Venturi type constriction so that the first partial gas current flowing through the branch line 5, which in the present embodiment terminates in a tapered central nozzle 4, is injected into the second fluid conduit 26. In the case shown in FIG. 2, the velocity distribution of the first gas current comprising first and second partial gas currents 1*a*, 1*b*, has a velocity distribution substantially the same as that shown in FIG. 1.

Figure 3:
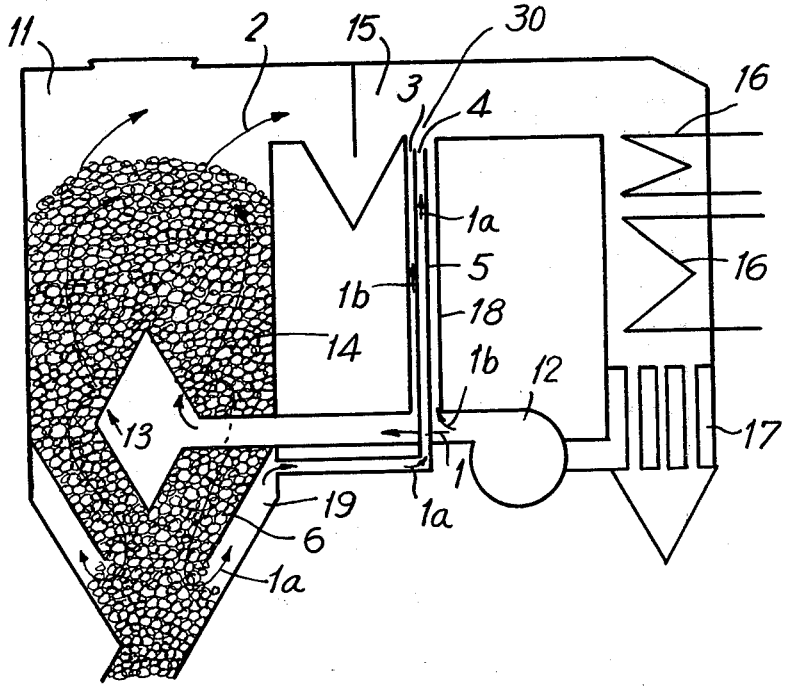
FIG. 3 is a schematic illustration of the cooling gas circuit of a coke dry cooling plant employing the method and apparatus of the present invention.

Referring now to FIG. 3, a dry cooling plant for cooling hot coke is illustrated. The coke is located in cooling chamber 11. A blower 12 is provided which draws in a cool gas 1 and directs the same through a passage into a distributor 13 located in intimate contact with the coke and cooling chamber 11. The cooling gas 1 flows through the hot coke layer 14 cooling the same whereby the gas temperature correspondingly increases. The now hot gas current, designated 2, is drawn from the cooling chamber 11 and is liberated of the entrained dust by a dry separator 15 arriving in its cleaned state at the point of mixing, designated 30.

A portion of cooling gas 1, designated 1a, which exits from distributor 13 is drawn into a conduit 5, analogous to branch line 5 in FIGS. 1 and 2, through an annular chamber 19 provided in the lower portion of cooling chamber 11. This gas current 1a is, of course, analogous to the first partial gas current 1a in FIGS. 1 and 2 and, similarly, becomes heated through contact with the hot coke, thereby increasing its velocity.

Further, a bypass conduit 18 communicates with the blower 12 and a second partial gas current designated 1b is directed through bypass line 18 to a ring nozzle 3. The heated, high velocity partial current 1*a* travels through branch line 5 and exits at a central nozzle 4 in a manner similar to that described in connection with FIGS. 1 and 2. Thus, at mixing point 30, the hot gas current 2 is mixed with the partial current 1*a*, 1*b* in a manner similar to that described in connection with FIGS. 1 and 2 to achieve the uniform temperature effects described in connection therewith. Thus, the temperature of the hot gas current 2 is decreased at mixing point 30 whereby the mixed gas is directed to the heating surfaces 16 of a heat exchanger. The cooled gases are then directed to a dry separator 17 whereupon it is finely cleaned. A similar cycle is then undergone with the blower 12 bringing the cooled gas current to a higher pressure.

It is understood that the second fluid conduit 26 at the point of mixing may be provided with a DeLaval type nozzle to facilitate intermixing.

Thus, according to the present invention, the first gas current 1 achieves a deep penetration into the second gas current 2 so that effective mixing occurs over the entire cross sectional area of the second gas current. The precise extent of such penetration may be precisely regulated through the action of throttle valve 8. Additionally, throttle valves 20*a* and 20*b* in first fluid conduit and branch line 5, respectively may be provided to obtain further control of the velocity distribution of the first gas current within the second gas current.

Obviously, numerous modifications and variations of the present invention are possible in the light of the above teachings. Accordingly, the present invention is defined in scope only by the following claims.

We claim:

1. A method for mixing a first relatively cool gas current and a second relatively hot gas current comprising the steps of:

separating the first gas current into a first partial gas current and a second partial gas current, said first partial gas current being smaller and having a greater velocity than said second partial gas current;

directing said second partial gas current into a ring nozzle, said ring nozzle being in fluid communication with said second gas current;

directing said first partial gas current into a central nozzle in fluid communication with said second gas current, said ring nozzle concentrically surrounding the central nozzle; and directing said first and second partial gas currents into said second gas current, the velocity of said first partial gas current being greater than the velocity of said second partial gas current.

2. A method as recited in claim 1 further including the step of regulating the flow of said first gas current by throttling said second partial gas current while maintaining the flow of said first partial gas current and, subsequently, throttling said first partial gas current.

3. A method as recited in claim 1 further including the step or heating said first partial gas current to increase the velocity thereof.

4. A method as recited in claim 1 wherein said separation step comprises drawing said first partial gas current from said first gas current by means of a blower and further comprising the step of directing the high velocity first partial gas current into said second partial gas current at a location immediately prior to the path of said second gas current.

5. A method for regulating the inlet temperature to a heat exchanger of the cooling gas current in a dry cooling plant for hot bulk material, such as coke or the like, comprising the steps of:

separating a relatively cool first gas current into a first partial gas current and a second partial gas current;

directing said first partial gas current into a cooling chamber of said cooling plant where it is heated to obtain a high velocity with respect to said second partial gas current;

directing a second gas current into the cooling chamber of said cooling plant where it is heated;

subsequent to heating of said first partial gas current, directing said first partial gas current into a central nozzle in fluid communication with said heated second gas current;

directing said second partial gas current into a ring nozzle in fluid communication with said heated second gas current, said ring nozzle concentrically surrounding the central nozzle; and directing said first and second partial gas currents into said second gas current and directing the mixture thereof to a heat exchanger of said cooling plant.

6. Apparatus for mixing a first gas current and a second gas current comprising:

means for conducting a first gas current;

means for separating said first gas current into a first partial gas current and a second partial gas current;

first conduit means for conducting said first partial gas current to a central nozzle;

a central nozzle having an inlet fluidly communicating with said first conduit means and an outlet fluidly communicating with said second gas current;

second conduit means for conducting said second partial gas current to a ring nozzle; and a ring nozzle concentrically surrounding said central nozzle having an inlet fluidly communicating with said second conduit means and an outlet fluidly communicating with said second gas current.

7. Apparatus as recited in claim 6 wherein said separating means comprises a branch juncture and said first conduit means comprises a conduit which branches from said second conduit means at said branch juncture.

8. Apparatus as recited in claim 7 further including a throttle valve located in said branch juncture.

9. Apparatus as recited in claim 6 further including means located within said first conduit means for increasing the pressure of said first partial gas current.

10. Apparatus as recited in claim 9 wherein said pressure increasing means comprises a heater.

11. Apparatus as recited in claim 10 wherein said pressure increasing means comprises a fan.

12. Apparatus as recited in claim 6 further including means for axially adjusting the position of said central nozzle within said ring nozzle.

13. Apparatus for regulating the temperature of a cooling gas current in a dry cooling plant for hot bulk materials, such as coke, comprising:

means for conducting a cooling gas current;

means for separating said cooling gas current into a partial cooling gas current and a second partial gas current;

distributor means for separating said partial cooling gas current into a first partial gas current and a hot gas current, said hot gas current being directed through said hot bulk material where it is heated;

first conduit means for conducting said first partial gas current to a central nozzle;

a central nozzle having an inlet fluidly communicating with the first conduit means and an outlet fluidly communicating with said heated hot gas current;

second conduit means for conducting said second partial gas current to a ring nozzle; and a ring nozzle concentrically surrounding said central nozzle having an inlet fluidly communicating with said second conduit means and an outlet fluidly communicating with said heated hot gas current.

* * * * *